US006907703B2

(12) United States Patent
Gonzalez

(10) Patent No.: US 6,907,703 B2
(45) Date of Patent: Jun. 21, 2005

(54) INTERLOCKING BLOCK

(76) Inventor: Jose M. Gonzalez, 3962 Minerva Ave., Los Angeles, CA (US) 90066

( * ) Notice: Subject to any disclaimer, the term of this patent is extended or adjusted under 35 U.S.C. 154(b) by 0 days.

(21) Appl. No.: 10/425,341

(22) Filed: Apr. 29, 2003

(65) Prior Publication Data

US 2004/0216411 A1 Nov. 4, 2004

(51) Int. Cl.[7] ..... E04B 5/04

(52) U.S. Cl. ..... 52/604; 52/608; 52/609; 52/71; 52/578

(58) Field of Search ..... 52/603, 604, 596, 52/591.1, 590.2, 590.3, 592.6, 592.5, 592.1, 608, 609, 98, 503, 570, 71, 578; 446/128, 125, 188, 124; 220/23.86, 23.4, 23.83, 23.6, 4.21

(56) References Cited

U.S. PATENT DOCUMENTS

| | | | | | |
|---|---|---|---|---|---|
| 1,294,446 | A | * | 2/1919 | Greenstreet | 446/122 |
| 3,264,021 | A | * | 8/1966 | Artman | 403/3 |
| 3,670,449 | A | * | 6/1972 | Lemkin et al. | 446/102 |
| 4,815,625 | A | | 3/1989 | Filhol et al. | |
| 5,024,067 | A | | 6/1991 | Maier, II | |
| 5,098,328 | A | * | 3/1992 | Beerens | 446/128 |
| 5,100,358 | A | * | 3/1992 | Volgger | 446/104 |
| 5,107,653 | A | | 4/1992 | Lewis | |
| 5,167,336 | A | | 12/1992 | Lajovic | 220/23.6 |
| D349,046 | S | | 7/1994 | Brown | |
| D352,077 | S | * | 11/1994 | Sher | 446/100 |
| 5,503,288 | A | | 4/1996 | Conconi | 220/4.21 |
| 5,615,529 | A | | 4/1997 | Johnson et al. | |
| 5,658,098 | A | | 8/1997 | Woolbright | |
| 5,810,192 | A | | 9/1998 | Cruz | 220/475 |
| D409,668 | S | * | 5/1999 | Madner | 446/108 |
| 5,992,665 | A | | 11/1999 | Deeter | 220/23.4 |
| 6,047,827 | A | | 4/2000 | Huang | |
| 6,186,855 | B1 | * | 2/2001 | Bauer et al. | 446/104 |
| 6,205,735 | B1 | | 3/2001 | Witcher | |
| 6,234,721 | B1 | | 5/2001 | Cronkhite et al. | |
| D447,944 | S | | 9/2001 | Justice | |
| 6,382,439 | B1 | | 5/2002 | Belokin et al. | |

* cited by examiner

*Primary Examiner*—Brian E. Glessner
*Assistant Examiner*—Chi Q. Nguyen
(74) *Attorney, Agent, or Firm*—Fulbright & Jaworski L.L.P.

(57) ABSTRACT

A five-sided interlocking block. At least one side, and preferably at least three sides, of the block is adapted to engage the same side of a similar block to interlock the blocks. At least one side of the block may also be adapted to rotatably engage the same side of a similar block. At least three sides of the block may also include anti-shear receptacles. The anti-shear receptacles on any side of two blocks may be aligned and shear prevention components inserted therein to interlock the blocks. The block may further include an optional interior space, enabling the block to be used as a container for appropriate material.

15 Claims, 12 Drawing Sheets

302
320
322
324
323
328
326
330
304

INTERLOCKING BLOCK

BACKGROUND OF THE INVENTION

1. Field of the Invention

The field of the present invention is interlocking building blocks and/or containers.

2. Background

Building blocks with interlocking features are known from the disclosures of U.S. Pat. Nos. 6,234,721, 6,205,735, and 5,107,653. Such interlocking building blocks facilitate the assembly of and provide additional stability to walled structures. However, the versatility of such blocks is typically limited by the design of the interlocking features. Thus, for most interlocking blocks, unless additional types of blocks or other components are introduced, only straight walls may be built.

Containers are also designed to be interlocking and stackable, one upon another, in order to facilitate storage and transportation, create additional stability, and optimize the use of space. Examples of such containers are disclosed in U.S. Pat. No. 5,167,336, and U.S. Design Pat. Nos. D349, 046 and D447,944. Such containers are primarily useful for the aforementioned reasons, or alternatively as building block toys for children after serving their primary function. Outside of these applications, such containers have little practical use and therefore little value.

SUMMARY OF THE INVENTION

The present invention is directed towards interlocking blocks. Each interlocking block comprises five sides, each side defining a planar interface. At least one side of the interlocking block is adapted to engage the same relative side of another like interlocking block.

In a first separate aspect of the present invention, the first side of a first interlocking block includes an elongated protrusion extending therefrom and a protrusion receptacle. The elongated protrusion of each block is adapted to engage the protrusion receptacle of a second similar block to interlock the two blocks. Thus, the elongated protrusion of the second block also engages the protrusion receptacle of the first block. To better interlock the two blocks, the protrusion receptacle may intersect a fastener receptacle on one of the other sides. The combination of the protrusion receptacle and the fastener receptacle form an interior passageway from the first side to the other side. When interlocked with such a configuration, the elongated protrusion extends through the interior passageway and may be secured with a fastener that is adapted to prevent the elongated protrusion from receding through the interior passage.

In a second separate aspect of the present invention, the second side of the interlocking block includes at least one flange and one flange receptacle. The flange and flange receptacle are adapted to engage the flange receptacle and flange, respectively, on the second side of a second similar block to interlock the two blocks. The second side of the interlocking block may also include at least two anti-shear receptacles which are adapted to receive shear prevention components. The anti-shear receptacles provide versatility in the manner the interlocking block may be combined with other similar interlocking blocks. For example, the sides of two interlocking blocks, each side including anti-shear receptacles, may be juxtaposed such that the anti-shear receptacles of each block are aligned with those of the other block. Shear prevention components having a depth greater than any one of the anti-shear receptacles may be inserted into the anti-shear receptacles. Thus, the shear prevention components will prevent the each block from sliding in a lateral direction relative to the other block.

In a third separate aspect of the present invention, the third side of the interlocking block includes at least one flange and one flange receptacle. The flange and flange receptacle are adapted to engage the flange receptacle and flange, respectively, on the third side of a second similar block to interlock the two blocks.

In a fourth separate aspect of the present invention, the second side of the interlocking block includes at least two ant-shear receptacles which are adapted to receive shear prevention components. The anti-shear receptacles provide versatility in the manner the interlocking block may be combined with other similar interlocking blocks as described further herein.

In a fifth separate aspect of the present invention, the second side of the interlocking block includes at least two ant-shear receptacles which are adapted to receive shear prevention components. The anti-shear receptacles provide versatility in the manner the interlocking block may be combined with other similar interlocking blocks as described further herein.

In a sixth separate aspect of the present invention, the five sides define an interior space of the interlocking block and the block includes an opening which allows the interior space act as storage for appropriate material, such as liquids, granular solids, or other form of particulate material, e.g., rice, corn, sugar, and salt. Such a block thus has a dual use as an interlocking block and as a storage container.

In a seventh separate aspect of the present invention, any of the foregoing aspects may be employed in combination.

Accordingly, it is an object of the present invention to provide an improved interlocking block and container. Other objects and advantages will appear hereinafter.

BRIEF DESCRIPTION OF THE DRAWINGS

In the drawings, wherein like reference numerals refer to similar components.

DETAILED DESCRIPTION OF THE PREFERRED EMBODIMENTS

Figure 1:
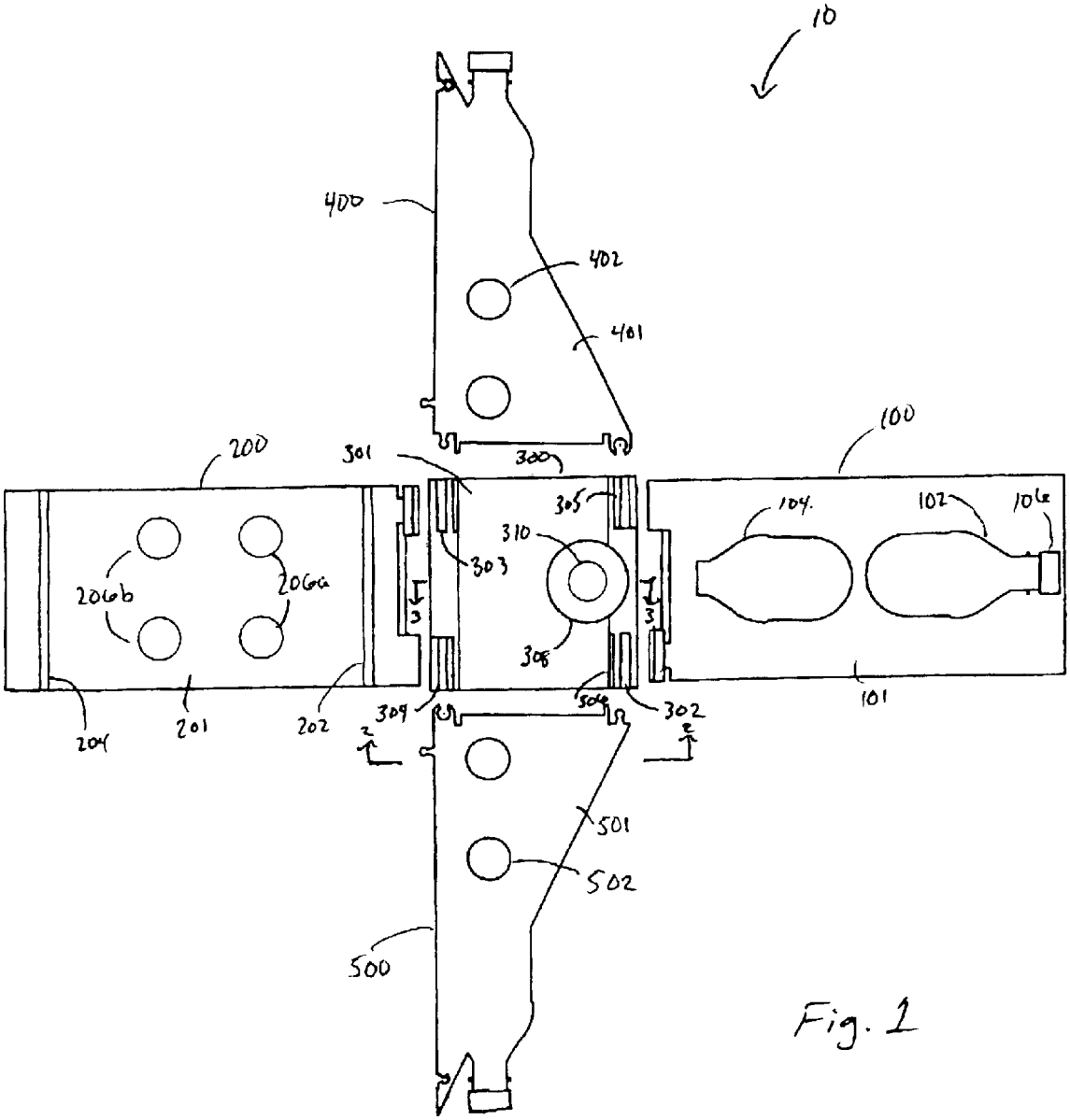
FIG. 1 illustrates a plan view of an interlocking container.

Turning in detail to the drawings, FIG. 1 illustrates an interlocking container 10, showing all five sides of the container in plan view. As can be seen from the figures, the five sides, when assembled, form a pentahedron. The container 10 is constructed from a recycled plastic, a material that is both light weight and durable. The first side 100 of the container 10 includes a substantially planar portion 101 that defines the planar interface between two interlocking containers when the first sides are engaged. An elongated protrusion, shown as a spout 102 in the figures, extends outward from the planar portion 101 at an acute angle. The spout 102 is formed in the shape of the top portion of a plastic beverage container, and is sealable by the container cap 106. A spout receptacle 104 extends inward from the planar portion 101 in the opposite direction of the spout 102. The angle of the spout receptacle 104, relative to the planar portion 101, is the same as the acute angle between the spout 102 and the planar portion 101. The overall shape of the spout receptacle 104 is complimentary to the shape of the spout 102, the spout receptacle 104 having the same general shape as the spout 102 and being appropriately sized so that the spout 102 of a second interlocking container may be inserted therein when the first sides of the two containers are engaged as shown in FIG. 4. The spout 102 and the spout receptacle 104 are illustrated in profile in FIG. 3.

The second side 200 of the container 10 includes a substantially planar portion 201 that defines the planar interface between two interlocking containers when the second sides are engaged. A flange 202 and a flange receptacle 204 are disposed on opposite sides of the second side 200. The flange 202 extends outward from the second side along the entire width of the container, while the flange receptacle 204 extends inward therefrom along the entire width of the container. The shape of the flange 202 is complimentary to the shape of the flange receptacle 204.

Figure 3:
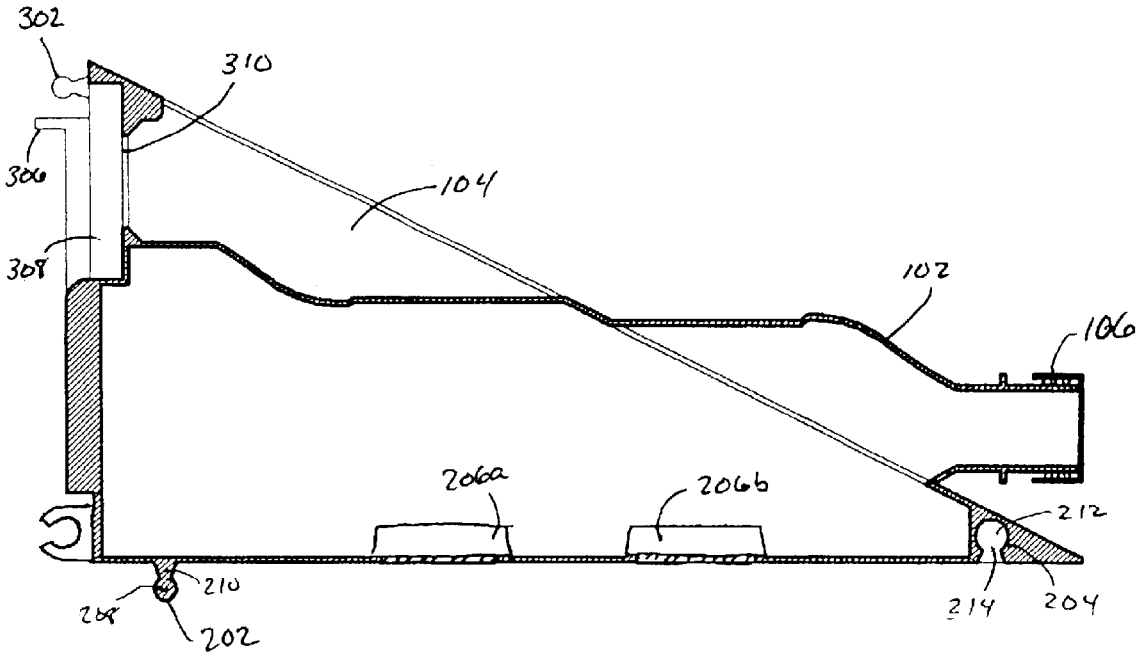
FIG. 3 illustrates a sectional view of the interlocking container along the line 3—3 of FIG. 1.
Figure 4:
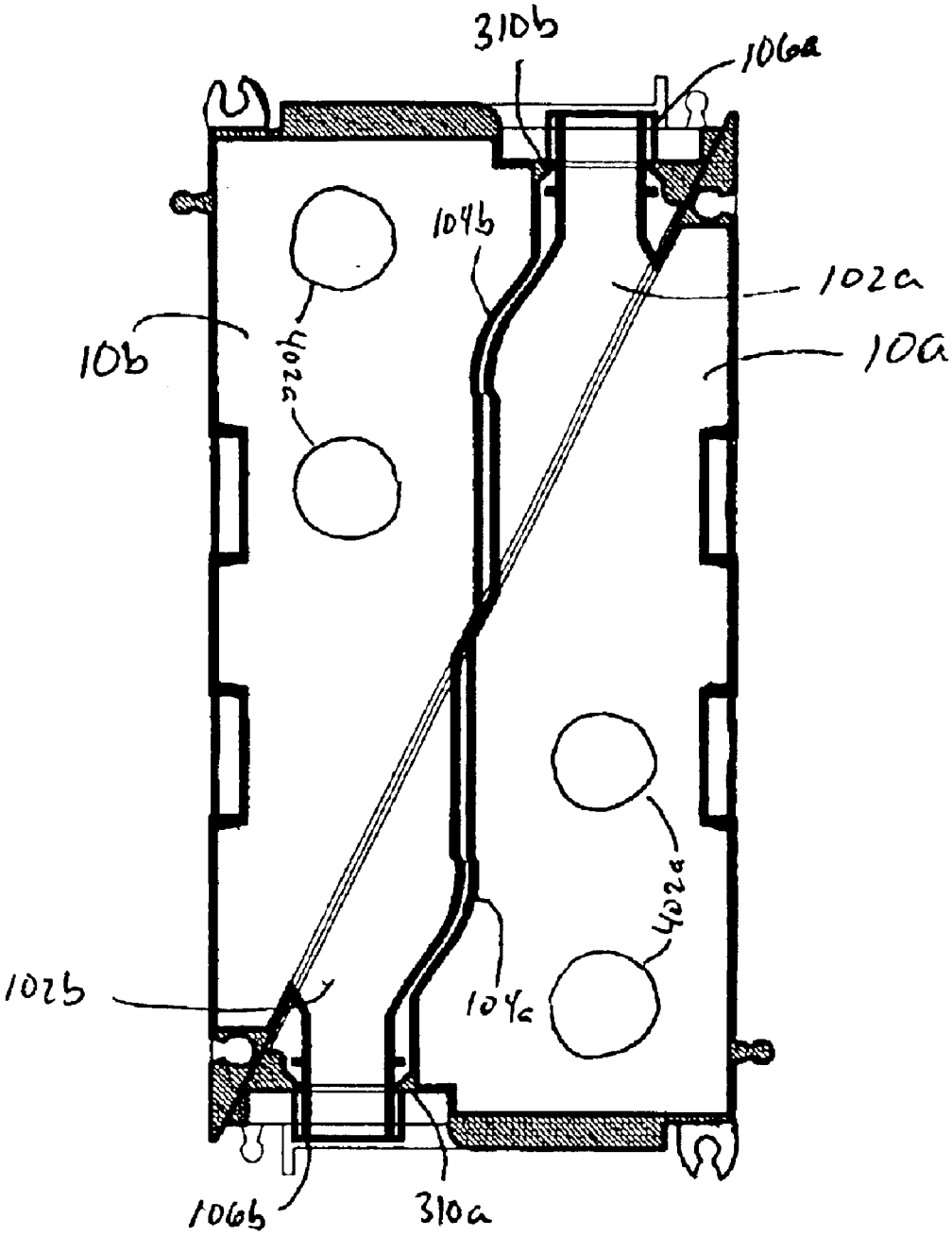
FIG. 4 illustrates two interlocking containers configured in a first orientation with the first sides engaged.

Referring to FIG. 3, the flange 202 comprises a cylindrical body 208 and an arm 210 that extends radially from and along the entire length of the cylindrical body 208. The arm 210 affixes the flange 202 to the second side 200. The overall diameter of the cylindrical body 208 is greater than the width of the arm 210. The flange receptacle 204 comprises a constricting portion 214 that broadens out into a cylindrical opening 212. The constricting portion 214 is appropriately sized to accept the arm of a flange from a second interlocking container while at the same time being smaller than the overall diameter of the cylindrical body. The cylindrical opening 212 is appropriately sized to axially accept the cylindrical body of a flange from a second interlocking container.

Returning to FIG. 1, the second side 200 further includes two pair of anti-shear receptacles 206*a*, 206*b*. Both pair of anti-shear receptacles 206*a*, 206*b* are symmetrically located and spaced to be alignable with either the anti-shear receptacles 502 on the fifth side of an interlocking container or the anti-shear receptacles 402 on the fourth side of an interlocking container when the first sides of the containers are engaged as shown in FIG. 4. Shear prevention components, discussed in further detail below, are insertable into the anti-shear receptacles to help stabilize the relative position of two containers when the anti-shear receptacles of the two containers are aligned side-by-side.

The third side 300 of the container 10 includes a substantially planar portion 301 that defines the planar interface between two interlocking containers when the third sides are engaged. Two flanges 302, 303 are disposed on opposite corners of the third side 300, and two flange receptacles 304, 305 are disposed on the other two opposite corners. A shoulder 306 is disposed near each flange 302, 303 to help align the flanges 302, 303 with the flange receptacles 304, 305 when engaging the third sides of two interlocking containers and provide additional stability when the third sides of two interlocking containers are engaged. The shoulders 306 extend from the main body of the container the same distance as the flange receptacles 304, 305, thus enabling the container stand upright on the third side 300 and remain level when placed on a horizontal surface.

Figures 8A, 8B, 8C, 8D, 8E:
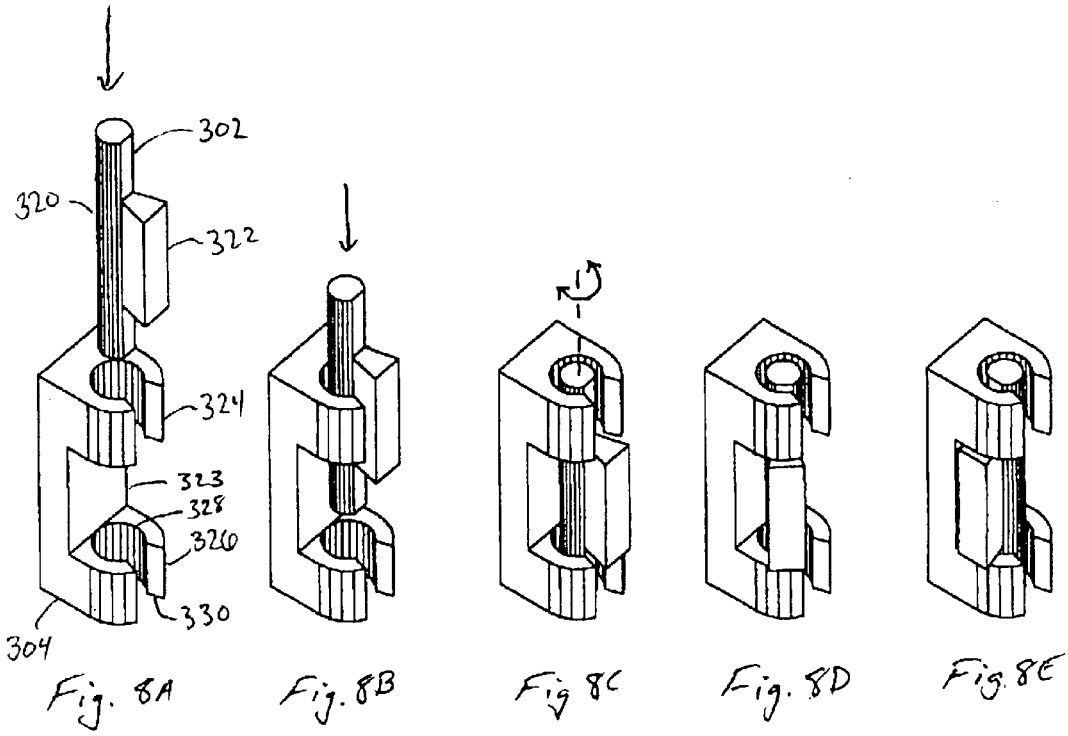
FIGS. 8A–E illustrate the rotational interaction of the flange and flange receptacle in the configuration of FIG. 7.

As shown in FIG. 8A, the flange 302 comprises a cylindrical body 320 and a radially extending arm 322 to affix the flange 302 to the third side 300. The arm 322 does not extend axially to the ends of the cylindrical body 320. The overall diameter of the cylindrical body 320 is greater than the width of the arm 322. The second flange 303 is the same as the flange 302 just described. The flange receptacle 304 comprises a block 323 with two pairs of outward extending fingers 324, 326. The two pairs of fingers 324, 326 are separated by a distance that is at least equal to the axial length of the arm of a flange 322. Each finger is appropriately curved so that each pair of fingers 324, 326 forms a cylindrical opening 328 and maintains axial alignment between the cylindrical body 320 and the cylindrical opening 328 when the flange 302 is inserted into the flange receptacle 304. The second flange receptacle 305 is the same as the flange receptacle 304 just described Returning to FIG. 1, the third side 300 further includes a fastener receptacle 308. As shown in FIG. 3, the fastener receptacle 308 intersects the spout receptacle 104 to form an interior passageway 310 through the container. The interior passageway 310, the end portion of the spout 102, and the container cap are all relatively sized so that the end portion of the spout 102 may pass through the interior passageway 310 but the container cap 106 may not pass therethrough. Thus, as shown in FIG. 4, when the first sides of two interlocking containers 10*a*, 10*b* are engaged, the spouts 102*a*, 102*b* of each container extend through the interior passageways of the opposite container 310*b*, 310*a* and are secured with the corresponding container caps 106*a*, 106*b*.

Figure 2:
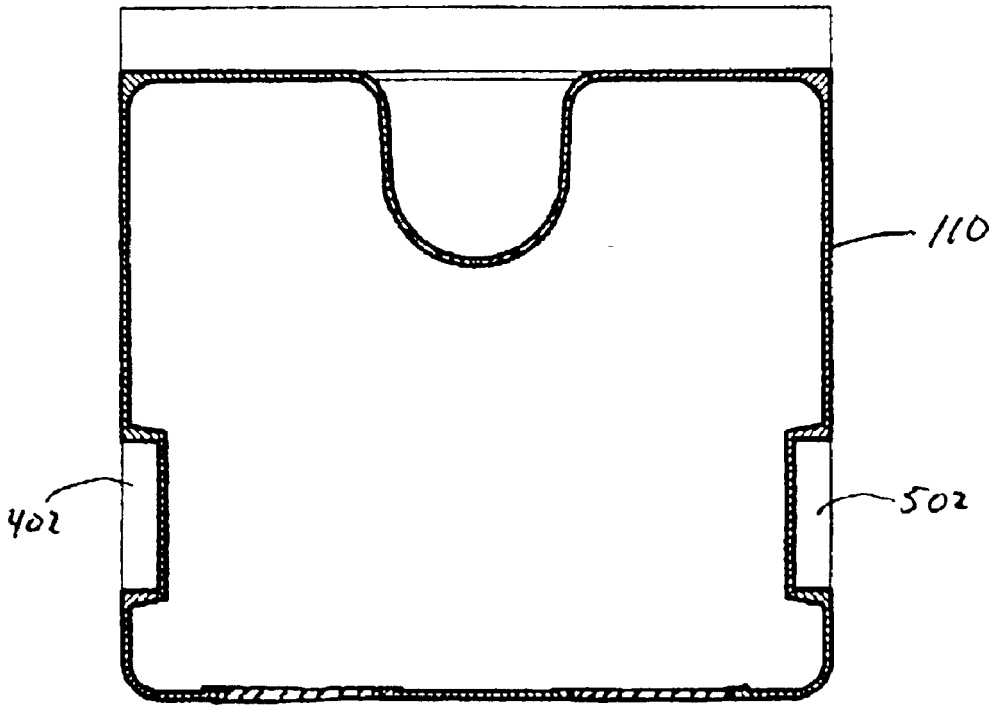
FIG. 2 illustrates a sectional view of the interlocking container along the line 2—2 of FIG. 1.
Figure 10:
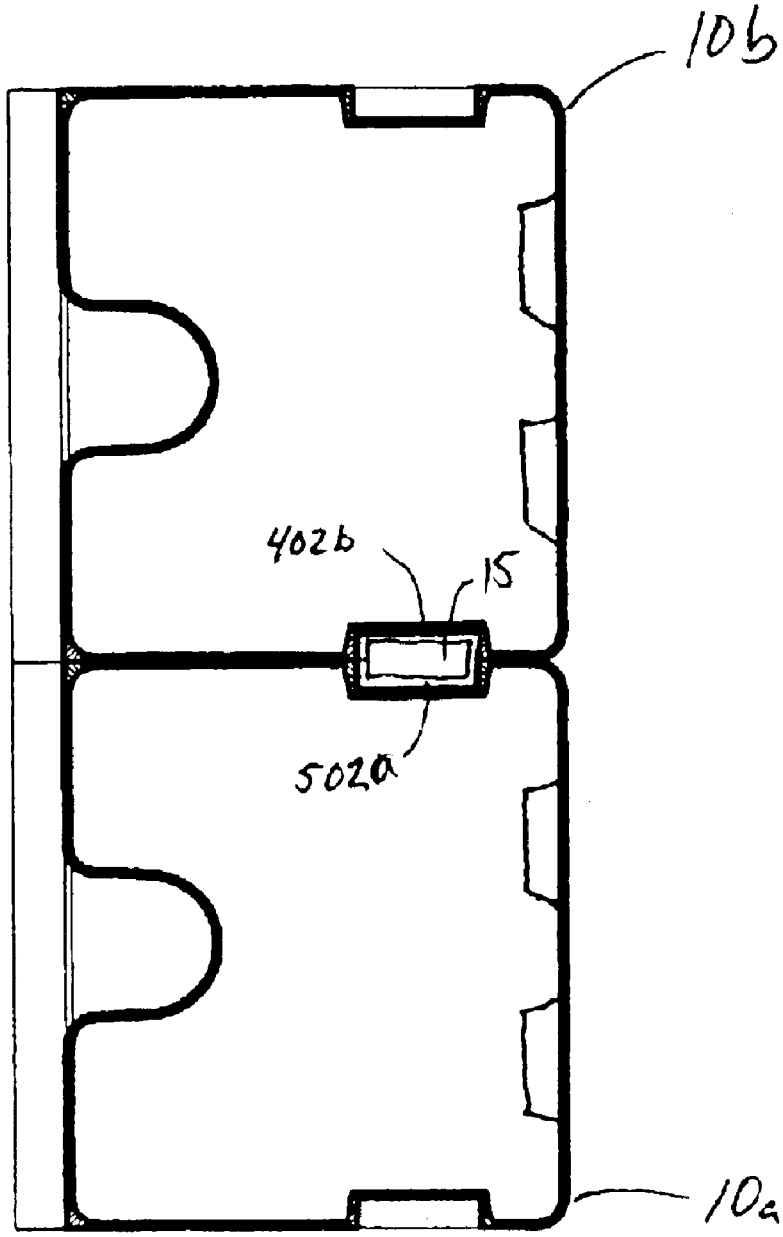
FIG. 10 illustrates two interlocking containers configured in a sixth orientation with the anti-shear receptacles of the fourth and fifth sides aligned.

The fourth side 400 of the container 10 includes a substantially planar portion 401 that defines the planar interface between two interlocking containers when the fourth side is adjacent either the second, fourth, or fifth side of the second container. The fourth side 400 further includes two anti-shear receptacles 402. The fifth side similarly includes a substantially planar portion 501 and two anti-shear receptacles 502. As shown in FIG. 2, the anti-shear receptacles 402, 502 have the same relative location and spacing on the fourth and fifth sides, respectively. Thus, as shown in FIG. 10, when the fifth side of a first container 10*a* is substantially adjacent the fourth side of a second container 10*b*, the anti-shear receptacles 502*a*, 402*b* are aligned. Shear prevention components are insertable into the anti-shear receptacles of the fourth and fifth sides to help stabilize the relative position of two containers when anti-shear receptacles of the two containers are aligned.

As discussed above, FIG. 4 illustrates two interlocking containers 10*a*, 10*b* with identical first sides engaged. When engaged thusly, all other sides of each container may be engaged with yet another interlocking container.

Figure 5:
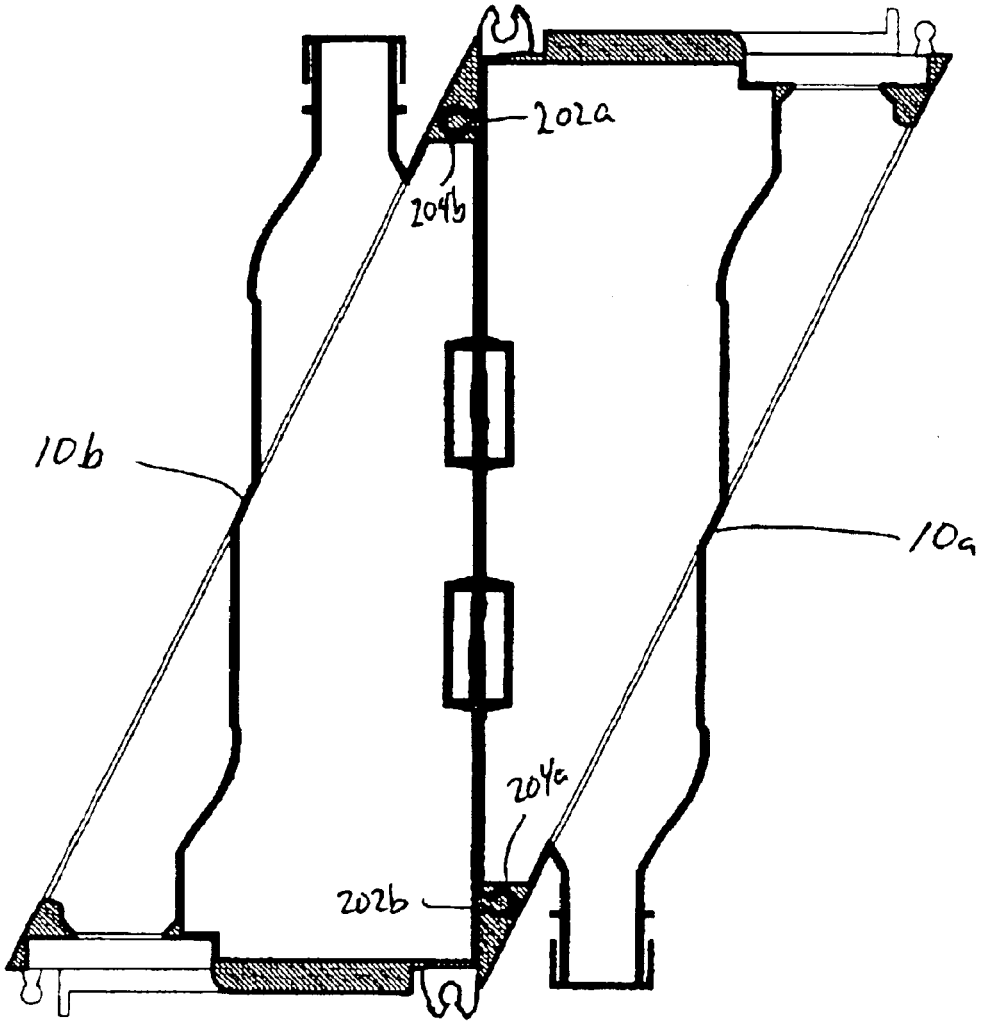
FIG. 5 illustrates two interlocking containers configured in a second orientation with the second sides engaged.

FIG. 5 illustrates two interlocking containers 10*a*, 10*b* with the second sides engaged. The second sides are engaged by aligning the cylindrical body of each container's flange 202*a*, 202*b* with the cylindrical opening of each container's flange receptacles 204*b*, 204*a* and sliding the containers in opposite directions parallel to the axial lines defined by the cylindrical bodies until the second sides are substantially aligned. In this configuration, all other sides of each container may be engaged with yet another interlocking container.

Figure 6:
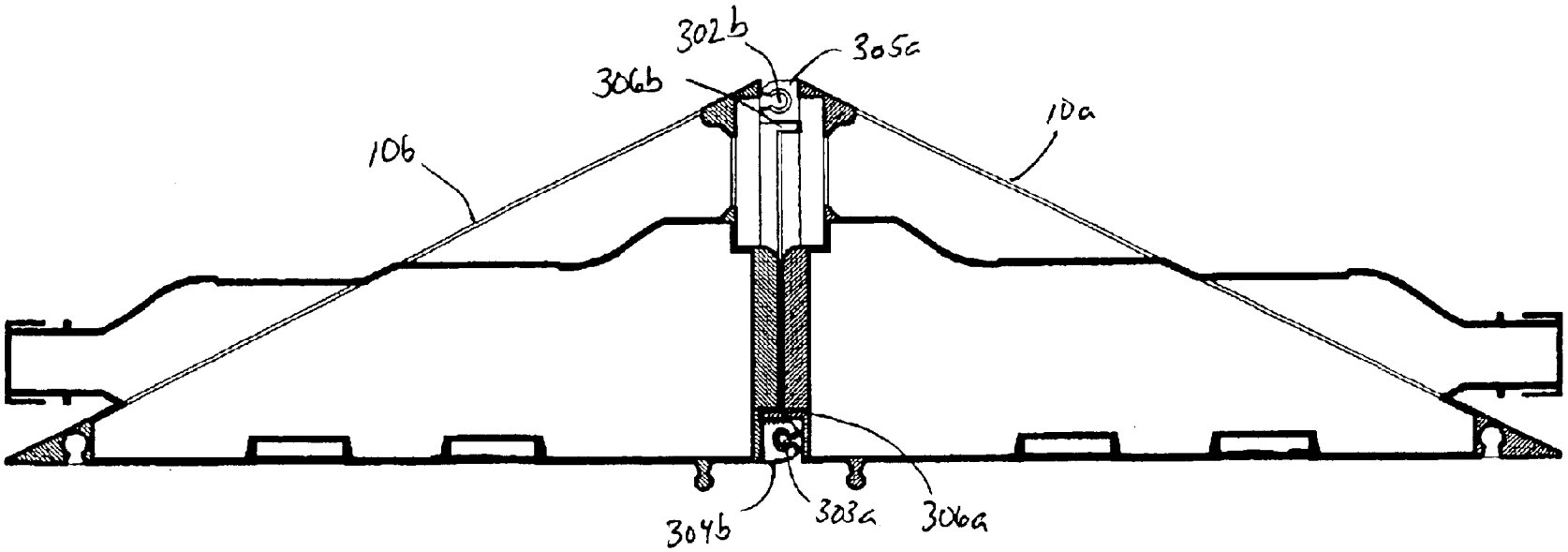
FIG. 6 illustrates two interlocking containers configured in a third orientation with the third sides engaged.

FIG. 6 illustrates two interlocking containers 10*a*, 10*b* with the third sides engaged. The flanges and flange receptacles on the third side of the first container 10*a* engage the flange receptacles and flanges, respectively, on the third side of the second container 10*b*. The third sides are engaged in this configuration by orienting the two interlocking containers accordingly with the cylindrical bodies of the flanges aligned with the cylindrical openings of the flange receptacles and sliding the containers in opposite directions parallel to the axial lines defined by the cylindrical bodies until the third sides are substantially aligned. In this configuration, all other sides of each container may be engaged with another interlocking container.

Figure 7:
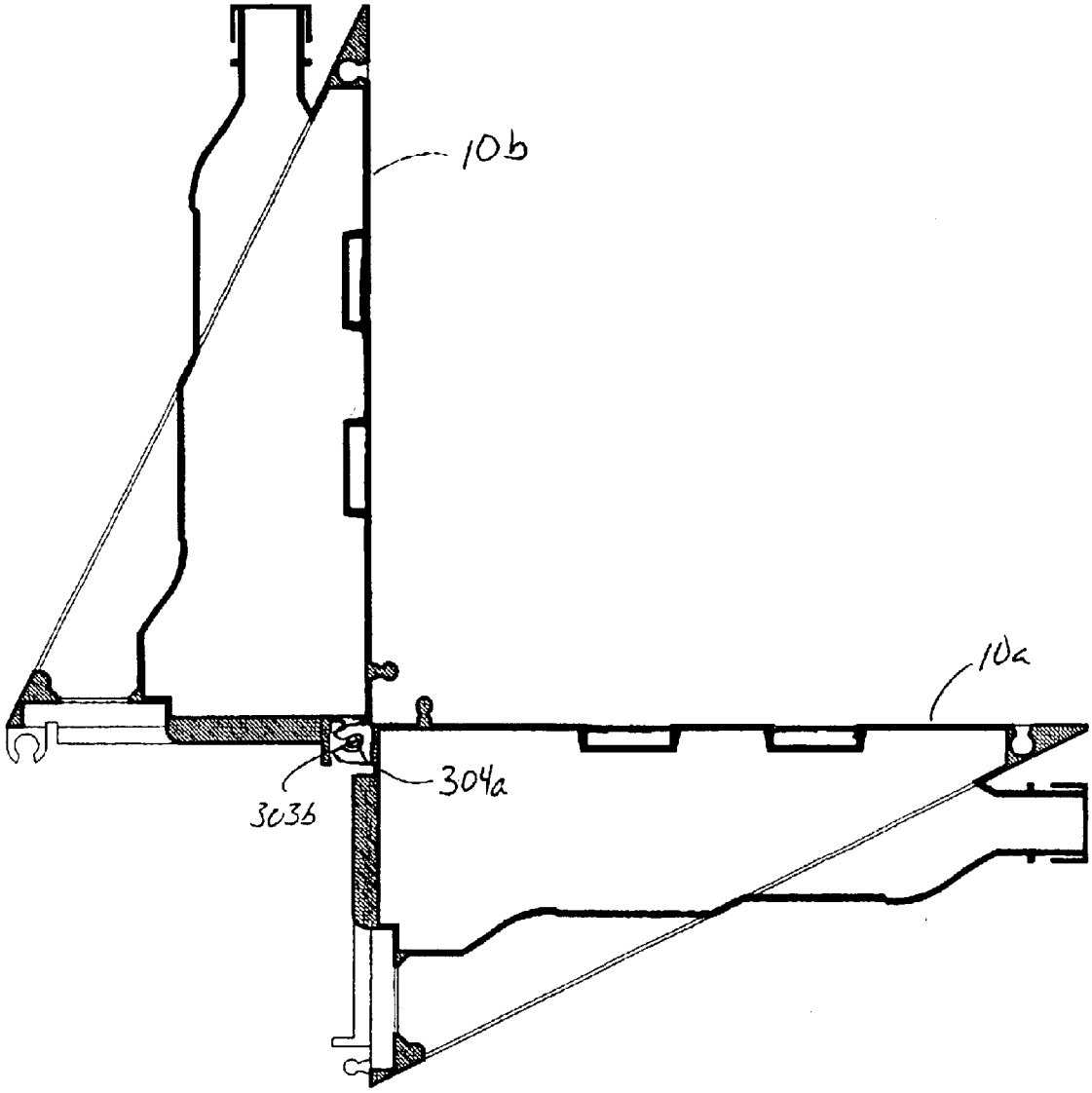
FIG. 7 illustrates two interlocking containers configured in a fourth orientation with the third sides rotatably engaged.

FIG. 7 illustrates two interlocking containers 10*a*, 10*b* with the third sides rotatably engaged. Only one flange and one flange receptacle on the third side of the first container 10*a* engage one flange receptacle and one flange, respectively, on the third side of the second container 10*b*. FIGS. 8A–E illustrate how the flange and flange receptacles are rotatably engaged. A loose tolerance exists between the tips of the fingers 324 on the flange receptacle 304 and the arm 322 on the flange 302 to permit engagement of the flanges and flange receptacles as shown in FIG. 7. In this configuration, the first, fourth, and fifth sides of each container may be engaged with another interlocking container.

Figure 9:
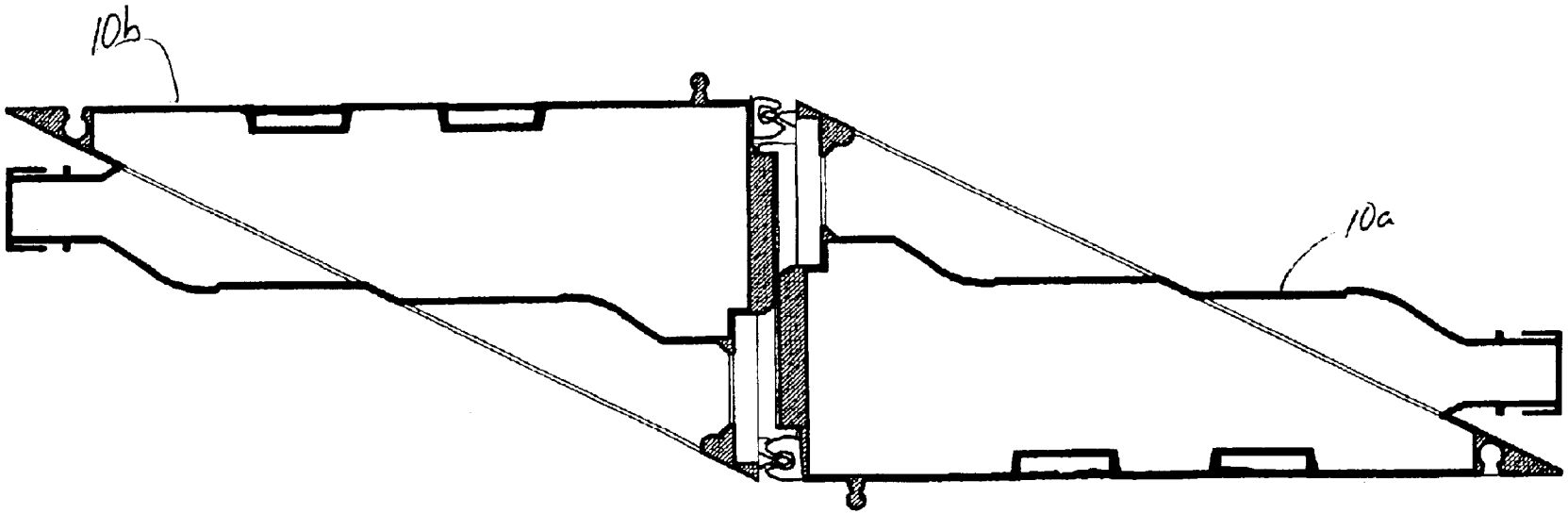
FIG. 9 illustrates two interlocking containers configured in a fifth orientation with the third sides engaged.

FIG. 9 illustrates two interlocking containers 10*a*, 10*b* with the third sides engaged in yet another orientation. The flanges and flange receptacles on the third side of the first container 10*a* engage the flange receptacles and flanges, respectively, on the third side of the second container 10*b*. This engagement is achieved in the same manner described in association with the configuration illustrated in FIG. 6. In this configuration, all other sides of each container may be engaged with another interlocking container.

FIG. 10 illustrates two interlocking containers 10*a*, 10*b* with the fifth side of the first container 10*a* substantially aligned with the fourth side of the second container 10*b*. The anti-shear receptacles of the two sides are aligned and a shear prevention component 15 is disposed in the space formed by the adjacent anti-shear receptacles 402*b*, 502*a*. The shear prevention component 15 may be any appropriate material that is at least semi-rigid and can be adapted to fit in the space formed by two anti-shear receptacles. The shear prevention component 15 has a height which spans the combined depths of the two anti-shear receptacles. Although a height that is at least greater than the depth of any single anti-shear receptacle is sufficient, greater stability is achieved when the shear prevention component 15 fills a greater amount of the space formed by two anti-shear receptacles. In the configuration of FIG. 10, all other sides of each container may be engaged with another interlocking container.

Figure 11:
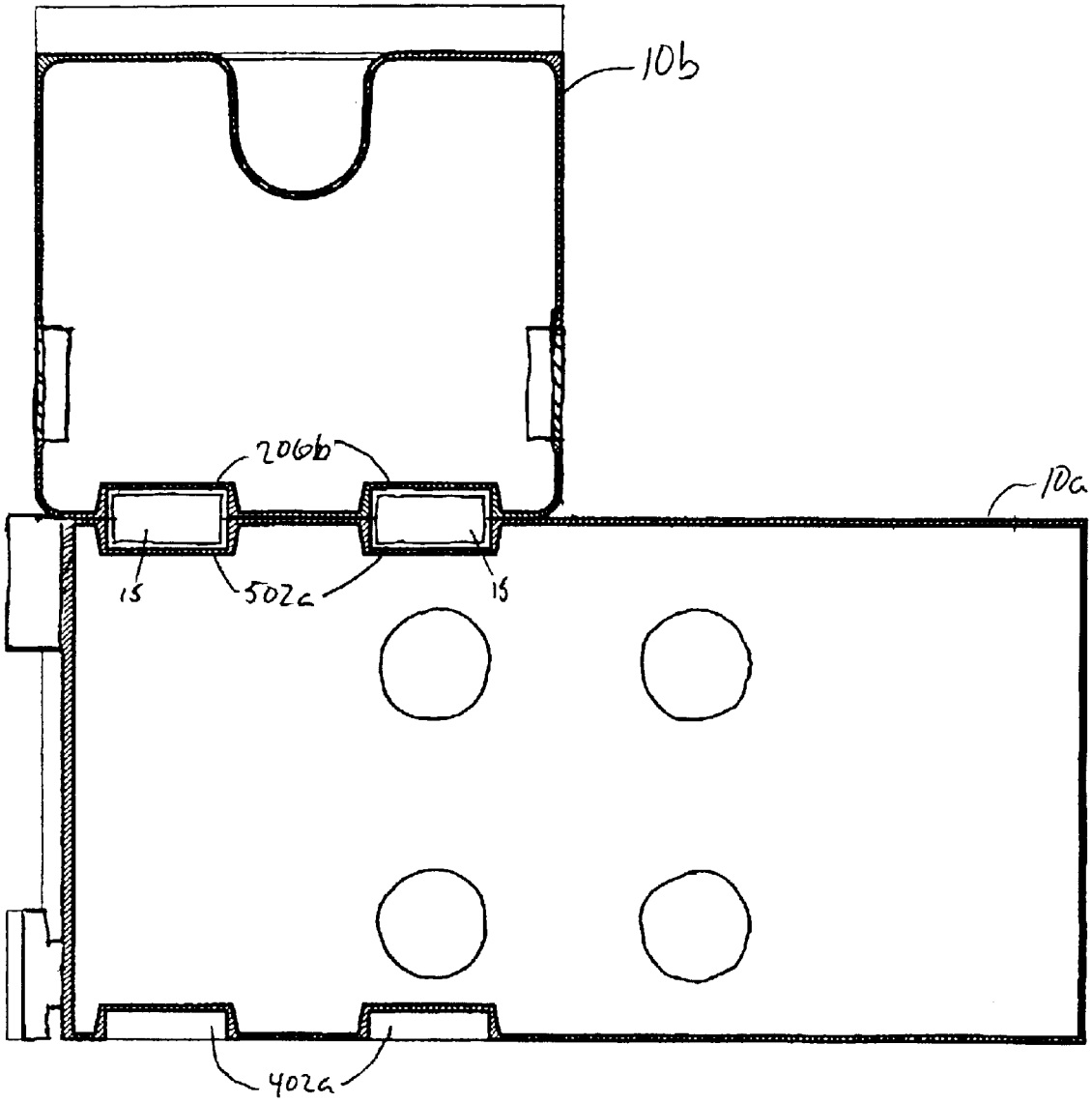
FIG. 11 illustrates two interlocking containers configured in a seventh orientation with the anti-shear receptacles of the second and fifth sides aligned.

FIG. 11 illustrates two interlocking containers 10*a*, 10*b* with the anti-shear receptacles 502*a* on the fifth side of the first container 10*a* aligned with the anti-shear receptacles 206*b* on the second side of the second container 10*b*. Shear prevention components 15 are disposed in the spaces formed by the aligned anti-shear receptacles. In this configuration, the first container 10*a* may be engaged with another interlocking container on the first, second, third, and fourth sides, and the second container 10*b* may be engaged with another interlocking container on the first, third, fourth, and fifth sides.

FIGS. 12A–E illustrate some of the different structures that may be formed using the interlocking container described herein. In forming such structures, additional structural integrity is added when appropriate by filling the containers with granular solids such as sand. Other fill may also be used, however, a granular solid is preferred because such fill is easy to work with and reduces the chance that the structure will lose integrity and collapse under its own weight.

Figure 12D:
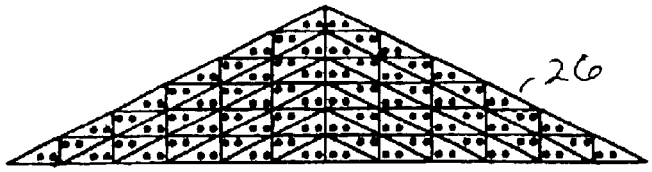
FIGS. 12A–E illustrate examples of structures which may be formed using a plurality of interlocking containers.
Figure 12C:
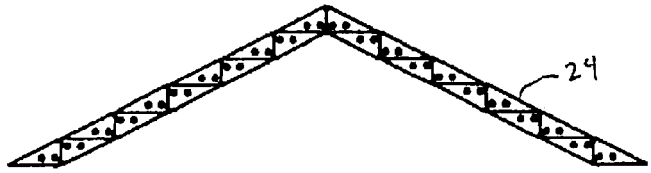
Figure 12E:
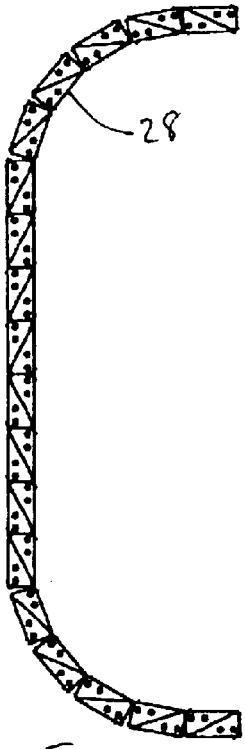
Figure 12B:
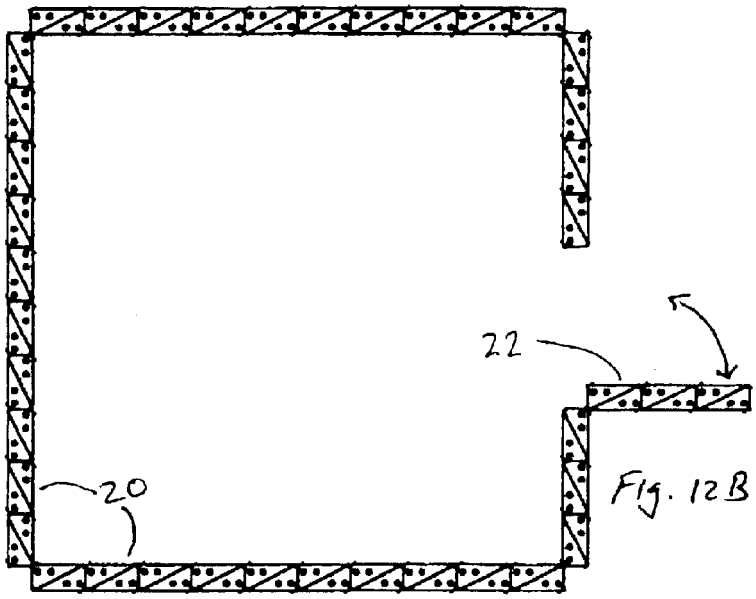
Figure 12A:
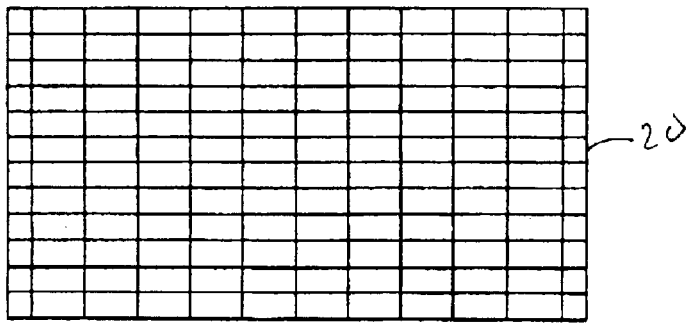

FIG. 12A illustrates a planar wall 20 that may be built using the interlocking configuration shown in FIG. 4. Each horizontal layer of interlocking containers in the wall are connected using the configurations shown in FIGS. 9 and 10. FIG. 12B shows walls 20 that may be built to form an enclosure with a hinged door 22. Each individual wall and the door are formed using the interlocking configurations shown in FIGS. 4 and 10. Each wall is connected at the corners to another wall using the interlocking configuration shown in FIG. 7. The door 22 is rotatably connected to the wall using the interlocking configuration shown in FIG. 7.

FIG. 12C illustrates a roof structure that may be constructed using interlocking containers. This structure is formed by connecting interlocking containers in the configurations shown in FIGS. 5, 6, and 9. The roof thus formed may be set on top of and connected to the walls of FIG. 12B using the interlocking configuration of FIG. 11.

FIG. 12D illustrates a second roof structure that may be constructed using interlocking containers. This structure is formed by connecting interlocking containers in the configurations shown in FIGS. 4, 5, 6, and 9. The roof thus formed may be set on top of and connected to the walls of FIG. 12B using the interlocking configuration of FIG. 11.

FIG. 12E illustrates a wall with curves that may be constructed using interlocking containers. The planar portion of the wall is formed using the interlocking configuration shown in FIGS. 4, 9, and 10. The curved portion of the wall is formed using the interlocking configuration shown in FIGS. 4, 7, and 10. Those skilled in the art will recognize that other forms of structures may be built using the interlocking configurations described herein.

Thus, an interlocking block is disclosed. While embodiments of this invention have been shown and described, it will be apparent to those skilled in the art that many more modifications are possible without departing from the inventive concepts herein. For example, while the embodiment disclosed comprises and interlocking container, those skilled in the art will recognize that the interlocking block may be solid throughout or have any other appropriate internal structure. By way of further example, the interlocking containers described and illustrated in the figures are constructed from recyclable plastics. Such plastics are frequently used to bottle consumables like water and carbonated drinks. Thus, portions of the illustrated interlocking containers take the form, or portions thereof, of the recycled materials used for construction. The interlocking containers described herein, however, may be constructed from a wide range of alternative materials. When constructing an interlocking block from alternative materials, the shape or form of most features described and illustrated herein may be altered without diverging from the basic principles of the invention. The invention, therefore, is not to be restricted except in the spirit of the following claims.

What is claimed is:

1. An interlocking building block system including at least a first building block and a second building block, wherein each building block comprises:

five sides forming a pentahedron, each side defining a planar interface, a first side including an elongated protrusion extending outwardly therefrom and a protrusion receptacle extending inwardly therefrom, wherein the elongated protrusion of each building block is adapted to engage the protrusion receptacle of the other building block to interlock the two blocks.

2. The interlocking building system of claim 1, wherein the second side of each block includes at least one flange and at least one flange receptacle, the flange and flange receptacle of the first block being adapted to engage the flange receptacle and the flange, respectively, of the second block.

3. An interlocking building block system including at least a first building block and a second building block, wherein each building block comprises:

five sides forming a pentahedron, each side defining a planar interface, the first side including an elongated protrusion extending therefrom and a protrusion receptacle, wherein the elongated protrusion of each building block is adapted to engage the protrusion receptacle of the other building block to interlock the two blocks, wherein the second side of each block includes at least one flange and at least one flange receptacle, the flange and flange receptacle of the first block being adapted to engage the flange receptacle and the flange, respectively, of the second block; and the second side of each block further includes at least two anti-shear receptacles adapted to accept shear prevention components.

4. The interlocking building system of claim 1, wherein the third side of each block includes at least one flange and at least one flange receptacle, the flange and flange receptacle of the first block being adapted to engage the flange receptacle and the flange, respectively, of the second block.

5. The interlocking building system of claim 1, wherein the fourth side of each block includes at least two anti-shear receptacles adapted to accept shear prevention components.

6. The interlocking building system of claim 1, wherein the fifth side of each block includes at least two anti-shear receptacles adapted to accept shear prevention components.

7. The interlocking building block of claim 1, wherein the five sides enclose an interior space and the elongated protrusion comprises a sealable spout.

8. An interlocking building block comprising:

five sides forming a pentahedron, each side defining a planar interface, wherein the first side includes an elongated protrusion extending outwardly therefrom and a protrusion receptacle extending inwardly therefrom;

the second side includes at least one first flange and at least one first flange receptacle;

the third side includes at least one second flange and at least one second flange receptacle; and the fourth side and the fifth side each include at least two anti-shear receptacles adapted to accept shear prevention components.

9. The interlocking building block of claim 8, wherein the protrusion receptacle has the same general shape as the elongated protrusion.

10. An interlocking building block comprising:

five sides forming a pentahedron, each side defining a planar interface, wherein the first side includes an elongated protrusion extending therefrom and a protrusion receptacle, wherein the elongated protrusion extends from the first side at an acute angle;

the second side includes at least one first flange and at least one first flange receptacle;

the third side includes at least one second flange and at least one second flange receptacle; and the fourth side and the fifth side each include at least two anti-shear receptacles adapted to accept shear prevention components.

11. An interlocking building block comprising:

five sides forming a pentahedron, each side defining a planar interface, wherein the first side includes an elongated protrusion extending therefrom and a protrusion receptacle;

the second side includes at least one first flange and at least one first flange receptacle, wherein the second side further includes at least two anti-shear receptacles adapted to accept shear prevention components;

the third side includes at least one second flange and at least one second flange receptacle; and the fourth side and the fifth side each include at least two anti-shear receptacles adapted to accept shear prevention components.

12. The interlocking building block of claim 8, wherein the third side is adjacent each of the other four sides.

13. An interlocking building block comprising:

five sides forming a pentahedron, each side defining a planar interface, wherein the first side includes an elongated protrusion extending therefrom and a protrusion receptacle;

the second side includes at least one first flange and at least one first flange receptacle;

the third side includes at least one second flange and at least one second flange receptacle, wherein the third side is adjacent each of the other four sides and the third side further includes a fastener receptacle which intersects the elongated protrusion receptacle, the combination of the fastener receptacle and the elongated protrusion receptacle defining an interior passageway between the first side and the third side; and the fourth side and the fifth side each include at least two anti-shear receptacles adapted to accept shear prevention components.

14. The interlocking building block of claim 8, wherein the fourth side is opposite and parallel to the fifth side.

15. The interlocking building block of claim 8, wherein the five sides enclose an interior space and the elongated protrusion comprises a sealable spout.

* * * * *